US005740688A

United States Patent [19]

Saluja et al.

[11] Patent Number: 5,740,688

[45] Date of Patent: Apr. 21, 1998

[54] PRESSURE-ASSISTED FORMATION OF SHAPED ARTICLES

[75] Inventors: Navtej S. Saluja, Arlington, Mass.; Alfredo Riviere V., Caracas, Venezuela

[73] Assignee: Sural Tech, Montreal

[21] Appl. No.: 539,371

[22] Filed: Oct. 5, 1995

[51] Int. Cl.[6] ..... B21C 23/00

[52] U.S. Cl. ..... 72/262; 72/260; 72/711

[58] Field of Search ..... 72/253.1, 256, 72/260, 262, 270, 352, 356, 354.2, 711

[56] References Cited

U.S. PATENT DOCUMENTS

| | | | |
|---|---|---|---|
| 2,223,385 | 12/1940 | Plessman . | |
| 3,451,240 | 6/1969 | Sauve . | |
| 3,451,241 | 6/1969 | Fuchs . | |
| 3,808,860 | 5/1974 | Yamaaguchi et al. . | |
| 3,872,703 | 3/1975 | Green . | |
| 4,044,587 | 8/1977 | Green et al. . | |
| 4,163,377 | 8/1979 | Moreau | 72/262 |
| 4,343,169 | 8/1982 | Moreau | 72/262 |
| 4,598,567 | 7/1986 | Backus | 72/262 |
| 5,152,163 | 10/1992 | Hawkes et al. . | |
| 5,157,955 | 10/1992 | Hawkes et al. . | |
| 5,167,138 | 12/1992 | Sinha et al. | 72/262 |
| 5,383,347 | 1/1995 | Riviere et al. | 72/262 |
| 5,490,408 | 2/1996 | Ando et al. | 72/253.1 |
| 5,598,731 | 2/1997 | Riviere et al. | 72/262 |

FOREIGN PATENT DOCUMENTS

| | | | |
|---|---|---|---|
| 14985 | 4/1974 | Japan . | |
| 0047510 | 3/1983 | Japan | 72/262 |
| 5245532 | 9/1993 | Japan | 72/262 |
| 0804045 | 2/1981 | U.S.S.R. | 72/253.1 |
| 1292895 | 2/1987 | U.S.S.R. | 72/270 |
| 974959 | 11/1964 | United Kingdom . | |
| 1370894 | 10/1974 | United Kingdom . | |
| 1504890 | 3/1978 | United Kingdom . | |
| 1507303 | 4/1978 | United Kingdom . | |
| 1566152 | 4/1980 | United Kingdom . | |
| 1590776 | 6/1981 | United Kingdom . | |

OTHER PUBLICATIONS

Long, H.W. "Some differences between direct and indirect extrusion of aluminum alloys."

Langerweger, J. and Maddock B. "Recent Developments in Conform and Castex Continuous Extrusion Technology" *Light Metal Age*, 23–28 (Aug. 1988).

Maddock, B. "Aluminum rod and other products by Conform" *Wire Industry*, 728–731 (Dec. 1987).

Parkinson, R.D. "Continuous cladding–Conform process" *Wire Industry*, 728–731 (Apr. 1986).

*Primary Examiner*—Lowell A. Larson
*Assistant Examiner*—Ed Tolan
*Attorney, Agent, or Firm*—Choate, Hall & Stewart

[57] ABSTRACT

An apparatus and method for the forming of a shaped article includes a means for plasticizing a feed material; a die chamber; a means for delivering a plasticized feed material from the plasticizing means and into the die chamber, the delivery means in flow communication with the plasticizing means and the die chamber; and means for applying a pressure to a material in the die chamber. In operation, a feed material is introduced into a plasticizing source; the plasticized feed material is delivered to a die chamber connectable in flow communication with the plasticizing source; and supplemental pressure is applied to the plasticized feed material within the die chamber.

20 Claims, 4 Drawing Sheets

PRESSURE-ASSISTED FORMATION OF SHAPED ARTICLES

FIELD OF THE INVENTION

The present invention relates to a method and apparatus for continuously producing a shaped article.

BACKGROUND OF THE INVENTION

The advantages of working a metal in its solid state, the equilibrium state under most working conditions, rather than its liquid state are well known. The enhanced reactivity of the metal in the liquid state makes it prone to reaction with the atmosphere or mold, die or furnace elements, resulting in the formation of solid inclusions and/or incorporation of dissolved gases into the melt. Processes involving molten metal also necessarily involve phase transformation associated with solidification shrinkage, evolution of dissolved gases and a number of casting defects.

On the other hand, working metal in the solid state requires a large amount of energy to deform the metal, necessitating heavy and expensive machinery. It is known to extrude a material, typically a soft metal (e.g., aluminum, copper, magnesium, zinc, silver and alloys thereof) in the form of a continuous cable, tube or ribbon through a die by maintaining frictional engagement of the material with a passageway defined by driving and non-driving surfaces, such that frictional drag maintains extrusion pressure and urges the material through the die ("frictional extrusion"). This process has been typically used for preparing continuous lengths of cable or tubing. The reader is directed to the prior art on continuous extrusion for more specific details, e.g., GB 1,370,894, GB 1,566,152, and GB 1,590,766.

It is desirable to develop a process capable of use for preparing massive structures of non-uniform cross-section because the process is relatively inexpensive in comparison to conventional metal-working processes, such as forging, and provides inherently higher quality materials than some less expensive casting processes. However, extrusion of large articles with non-uniform cross-sectional areas results in variation of extrusion processing conditions, such as velocity and pressure, along the extrusion pathway. Such processing variations can result in increased porosity and/or inclusions, as well as other structural defects in the final product.

In conventional extrusion processes, the surface over which extrusion occurs is small and the extrusion pressure is correspondingly small, as well. When it is desired to extrude a metal into a die chamber of reasonable complexity, the material must move (be extruded) over a large regions of varying cross-sectional area. The forces on the material are required to be very large. Hence, conventional continuous extrusion processes are not readily amenable to the preparation of large metal pieces.

In U.S. Pat. No. 5,383,347, the inventors disclosed a method of using frictional extrusion to continuously form a shaped article. The method and apparatus direct a frictionally extruded feed material into a holding chamber and, from there, into one of a plurality of die chambers. The method and apparatus permit the extrusion of large metal pieces of complex shape that can not be readily prepared by conventional extrusion processes. The method is limited, however, in that extrusion pressures no greater than that of the frictional extrusion source can be exerted on the feed material. Additionally, residence time in the extrusion process can be long and frictional losses to the chambers and conduits result in a further reduction in extrusion pressure.

Thus, some porosity may remain in the final piece, which may be unacceptable for structural or load bearing articles.

There have been attempts in the prior art to provide a feed material that is in the semi-solid or plastic state for use in die casting operations. These techniques have been commercially unsuccessful, largely because of the high expense associated with the preparation of the semi-solid starting material. The starting material for semi-solid metal casting is a continuously cast fine-grain billet produced using electromagnetic stirring to produce a grain texture of solid spheroids suspended in molten metal. The billets are then inductively heated with very tight temperature tolerances and are automatically loaded into the sleeve of a die casting machine. The material is cast when it is about 60% solid and 40% liquid. The material is stiff enough to retain its shape, yet the globular microstructure of the solid spheroids suspended in molten metal allows the material to be cut like butter. Although the semi-solid metal provides good properties for casting, materials processing cost makes this method cost-prohibitive.

It would be desirable to have an apparatus and method which would allow the forming of a plastic material into complex shapes with reduced porosity and gas entrapment in a cost-effective process.

It is an object of the present invention to provide a method and apparatus for the forming of complexly shaped metal articles with reduced porosity and increased strength.

It is an object of the present invention to provide a method and apparatus for the extrusion of large metal pieces with complex shape that cannot be readily prepared using conventional extrusion processes.

It is a further object of the present invention to provide a method and apparatus for the formation of a plastic material into a complex shape which provides additional forming pressure to reduce porosity and gas entrapment.

It is a further object of the present invention to provide a method and apparatus for forming complexly shaped structural and load-bearing articles.

It is a further object of the present invention to provide a method and apparatus for forming complex shaped structural articles which can be subsequently heat treated with retention of excellent surface finish, that cannot be readily prepared using high pressure die casting techniques.

It is yet another object of the invention to provide a method and apparatus for forming low-porosity and low-inclusion content articles that require minimum machining and finishing to achieve final dimensions and surface finish, that cannot be readily prepared using casting processes.

The present invention provides a high quality article with excellent structural and dimensional properties, at a lower cost than conventional metal-working processes.

SUMMARY OF THE INVENTION

In one aspect of the invention, an apparatus for the forming of a shaped article is provided which includes means for plasticizing a feed material; a die chamber; means for delivering a plasticized feed material from the plasticizing means and into the die chamber, the delivery means in flow communication with the plasticizing means and the die chamber; and means for applying a pressure to a material in the die chamber. The pressure of the pressure means supplements the pressure of the plasticizing means.

In a preferred embodiment, the delivery means comprises a chamber for holding a plasticized material received from the plasticizing means, the holding chamber in flow communication with the plasticizing means and the die chamber.

In another preferred embodiment, the pressure means comprises a means for applying hydrostatic pressure or a member capable of movement from a first position spaced apart from the die chamber to a second position in abutment with a material in the die chamber. The member may be a solid piston or plunger. In another preferred embodiment, the means for applying pressure comprises a member capable of movement form a first position spaced apart from the die chamber to a second position in abutment with the die chamber, the member positioned and located adjacent to the holding chamber, such that movement from the first position to the second position of the member causes the member to pass through the holding chamber. In yet another preferred embodiment, the means for applying pressure comprises a piston housing adjacent to the die chamber; and a slidable member housed within the piston housing, the member capable of movement from a first position spaced apart from the die chamber to a second position in abutment with a material in the die chamber.

The means for applying pressure may apply pressure remote from a location where plasticized material is delivered into the die chamber. The means for applying pressure and the means for delivering a plasticized material into a die chamber may be positioned and located so as to permit delivery of the plasticized material into a die chamber and application of pressure at a same location.

In another preferred embodiment, the means for applying pressure and the delivery means together comprise a sleeve in flow communication with the die chamber which has an inlet in flow communication with the plasticizing means for receiving a feed material from the plasticizing means; and a slidable member housed within the sleeve, the member capable of movement from a first position spaced apart from the die chamber to a second position in abutment with a material in the die chamber, whereby a material is capable of entering the die chamber under pressure. The sleeve comprises an inlet for receiving plasticized feed material, the inlet flowise downstream from the first position of the slidable member.

In yet another preferred embodiment, the delivery means and the means for applying a pressure together comprise a chamber for holding a plasticized material received from the plasticizing means, the holding chamber in flow communication with the plasticizing means; a sleeve having an inlet in flow communication with the holding chamber for receiving feed material from the holding chamber and a outlet adjacent to and in flow communication with the die chamber; and a slidable member housed within the sleeve, the member capable of movement from a first position spaced apart from the die chamber and flowwise upstream from the inlet to a second position abutting the die chamber. The sleeve may be adapted for delivery of a metered amount of material into the die chamber. In a preferred embodiment, the apparatus further comprises heating means for the heating of the holding chamber, die chamber and/or the sleeve.

In another aspect of the invention, an apparatus for the extrusion of a shaped article includes means for plasticizing a feed material; a die chamber; a chamber for holding a plasticized material received from the plasticizing means, the holding chamber in flow communication with the plasticizing means; means for delivering a plasticized feed material from the holding chamber and into the die chamber, the delivery means in flow communication with the die chamber; a sleeve having an inlet in flow communication with the plasticizing means and a outlet adjacent to and in flow communication with the die chamber; and a slidable member housed within the sleeve, the member capable of movement from a first position spaced apart from the die chamber and downstream from the inlet to a second position abutting the die chamber.

The means for plasticizing a feed material may be selected from the group consisting of a frictional extrusion source, a hydrostatic extrusion source, hot forging and cold forging. A suitable frictional extrusion source comprises a first moving surface and a second non-moving surface in facing relationship, the first and second surfaces defining between them a passageway, the passageway including an entry point for introduction of a feed material and an exit point for release of frictionally extruded material.

In another aspect of the invention, a shaped article is formed by introducing a feed material into a plasticizing source; delivering the plasticized feed material to a die chamber connectable in flow communication with the plasticizing source; and applying a supplemental pressure to the plasticized feed material within the die chamber. The pressure supplements the pressure of the plasticizing source.

In another aspect of the invention, a shaped article is formed by introducing a feed material into a frictional extrusion source; receiving extruded feed material from the extrusion source in a metering sleeve, the metering sleeve in flow communication with the frictional extrusion source; applying pressure to the extruded material within the metering sleeve; and directing extruded material from the metering sleeve under pressure into a die chamber connectable in flow communication with the metering sleeve.

In preferred embodiments, the feed material is monitored from the holding chamber; and sealing means disposed in each outlet conduit are selectively controlled to control flow of extruded material therethrough. Monitoring is accomplished using a sensing technique selected from a the group consisting of ultrasonic, pressure, electromagnetic, laser ultrasonic, and inductive techniques. Monitoring occurs at points flowise downstream of the respective outlet conduits at a preselected distance therefrom. The feed material is extruded at an elevated temperature, preferably substantially 0.8 $T_m$.

BRIEF DESCRIPTION OF THE DRAWING

The invention is described with reference to the following drawings, in which.

DESCRIPTION OF THE PREFERRED EMBODIMENT

Massive metal structures are typically fabricated using either casting from molten metal or forging. While casting is often a less expensive procedure, it introduces impurities and/or porosity into the casting which degrades the structure and makes the process unacceptable for certain applications. Additionally, segregation of the alloying components in the casting during solidification causes non-uniform properties at different spatial locations in the casting. Forging produces a high quality article at a much greater expense. The metal quality improves during forging operations due to work hardening. During work hardening, plastic deformation changes the dislocation structure of the metal, resulting in an increase in strength or stress of the metal. Plastic deformation should occur at temperatures that are low relative to the melting point of the metal.

Plastic deformation on a plasticized feed material makes it possible to work harden the finished article, while using a less expensive forming process. The present invention provides an apparatus and method for preparing shaped articles having reduced porosity and improved strength. The invention provides for a means for plasticizing a feed material and a means for delivering the feed material into a die chamber. In order to improve material strength and reduce porosity, pressure is applied to the feed material within the die chamber.

Figure 1:
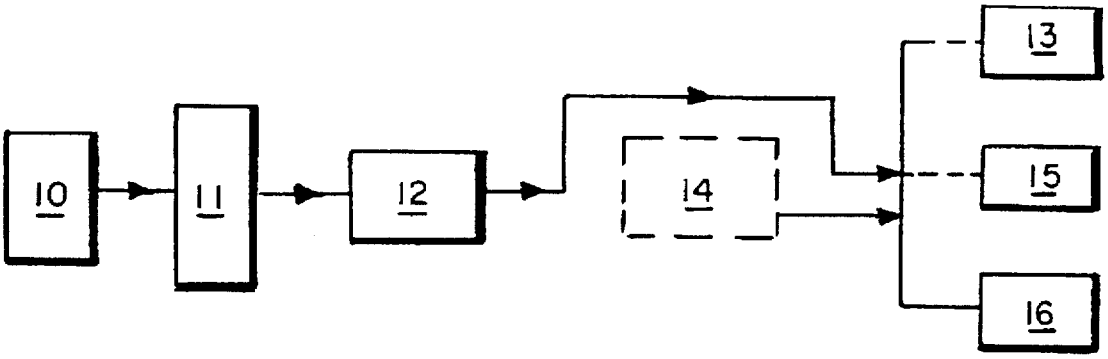
FIG. 1 is a schematic illustration of a first embodiment of the invention.

With reference to FIG. 1, a plasticizing means 11 is provided which is capable of plasticizing a feed material 10. The feed material 10 is typically a soft metal, such as aluminum, copper, magnesium, zinc, silver or alloys thereof, which can be made "plastic" or easily formable under the conditions of the plasticizing means. Conventional plasticizing means may be used in accordance with the invention. Such plasticizing means typically involve the use of mild heating and pressure to render the feed material into a formable state. Suitable plasticizing means include, but are in no way limited to, extrusion and forging techniques. Extrusion processes, in which feed material in the form of powders, rods or billets are subjected to extrusion pressures for the purposes of plasticizing and not shaping the material, are contemplated. Frictional or hydrostatic extrusion may be used to provide a plasticized feed material. Further, hot and cold forging processes may be used in a batch process to provide a plasticized feed material according to the invention.

The plasticized material 11 is then delivered into a die chamber 13. The feed material may be introduced into the die chamber 13 via a holding chamber 12. The plasticized material may be continuously introduced into the die chamber. Alternatively, it may be introduced in a metered fashion into the die chamber. Various means of delivering the plasticized material into the die chamber are discussed hereinbelow.

Either concurrent with or subsequent to the delivery of the feed material to the die chamber, a pressure means 14 is employed to apply pressure to a feed material within the die chamber. The applied pressure can supplement the pressure of that which is obtained solely by the plasticizing means. Typical forces applied by the pressure means to the feed material within the die chamber is in the range of 40–200 tons, although actual pressure is a function of the area over which the force is applied. The pressure additionally may assist in the delivery of the feed material into the die chamber. Pressure is maintained on the die chamber until the formed article is ready to be ejected from the die. The pressure reduces voids in the casting, especially where the cast article is of a complex geometry and where there are regions of sudden increase or decrease of cross-sectional area. It also work hardens the material and improves the mechanical strength of the final article.

Figure 2:
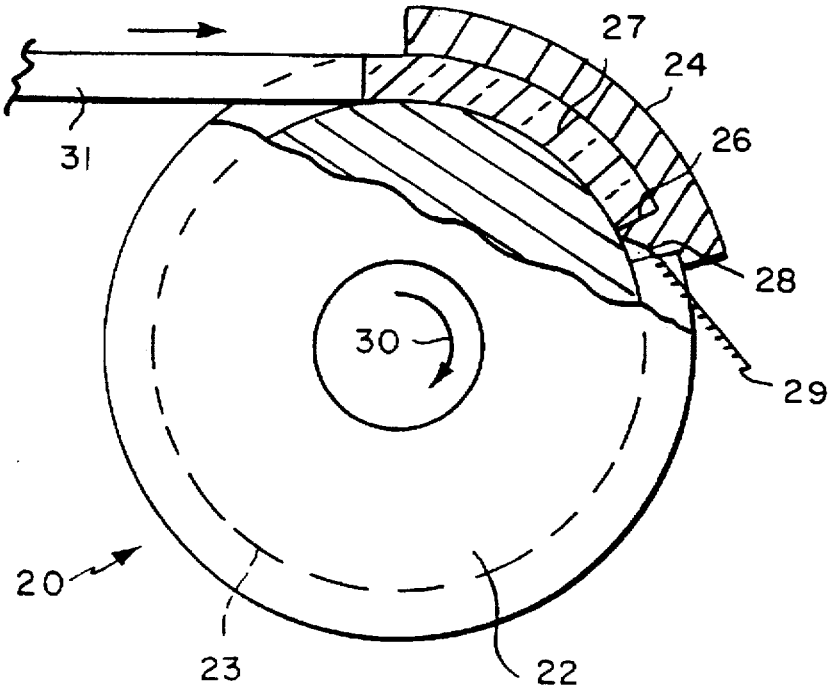
FIG. 2 PRIOR ART
FIG. 2 is a cross-sectional view of a conventional frictional extrusion apparatus which may be used with the present invention.

A first embodiment of the invention is described with reference to FIGS. 1 through 3. Throughout the figures, like elements are similarly numbered. The feed material 10 is provided and introduced into the plasticizing means 11. In a preferred embodiment, a frictional extrusion apparatus may be used as the plasticizing means 11. With reference to FIG. 2, a conventional frictional extrusion source suitable for use in combination with the present invention is described. The extrusion apparatus 20 has a rotatable wheel 22 having a circumferential endless groove 23 therein. The groove 23 is engaged with a shoe member 24 having an abutment 26 which is disposed in the groove 23, thereby blocking passageway 27 which is bounded by the groove 23 and shoe member 24. An opening 28 is positioned near the abutment 26 for release of a frictionally extruded feed material 29. The opening 28 can be situated in the shoe so that the extrusion product 29 is emitted either radially or tangentially from the wheel. FIG. 2 depicts the product 29 extending tangentially outward from the groove. It will be appreciated that other plasticizing means may be used in place of the frictional extrusion apparatus.

The plasticized feed material may then be directed into the holding or expansion chamber 12. FIG. 3 shows a cross-section of an apparatus having a passageway 27, a holding chamber 42 and a die chamber 13. It is understood that the scope of the present invention is not limited thereby and any number of passageways and holding chambers and die chambers is within the scope of the present invention. An apparatus for the continuous extrusion of shaped articles disclosed in U.S. Pat. No. 5,383,347, which is incorporated herein in its entirety by reference, may be used for the continuous extrusion of shaped articles which uses multiple passageways, holding chambers and die chambers.

Figure 3:
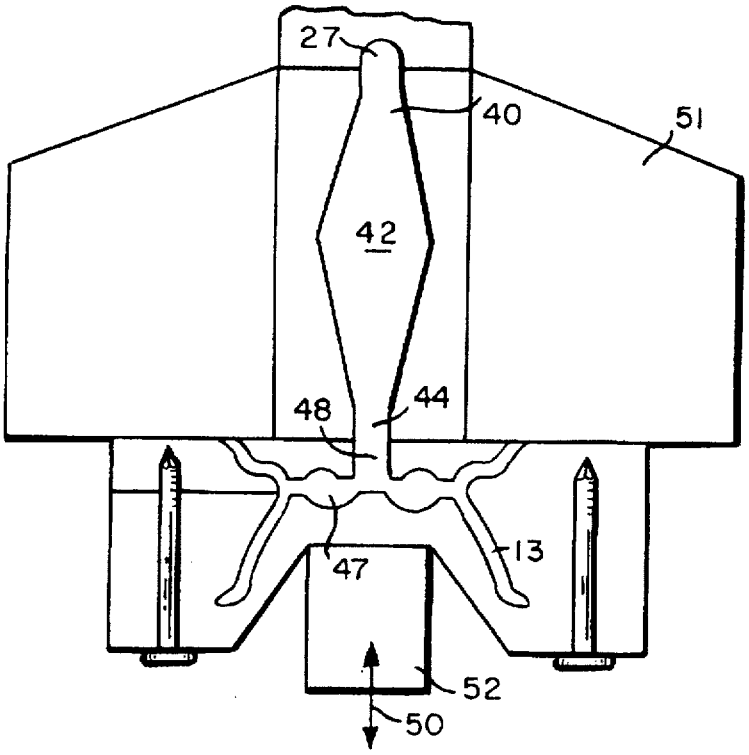
FIG. 3 is a cross-sectional view of a holding chamber and die chamber which may used in the apparatus of the invention.

Passageway 27 shown in part in the upper portion of FIG. 3 directs the plasticized feed material from the plasticizing means into the holding chamber 42. A conduit 40 connects the passageway 27 to an entry end of the holding chamber 42. The holding chamber 42 is capable of receiving plasticized material from the plasticizing means. Within the holding chamber 42, the plasticized material is spread across a large cross-sectional area to permit the filling of a die chamber having a cross sectional area larger than the cross-sectional area of the feed material. The holding chamber 42 additionally promotes the mixing of the material prior to delivery into the die chamber to produce a more homogeneous mixture. Mixture of the plasticized material can be further promoted by inclusion of mixing blades (not shown) in the holding chambers 42. An outlet conduit 44 is located at an exit end of the holding chamber 42 which puts the holding chamber in flow communication with the die chamber.

The plasticized feed material is then directed into a die chamber 13. Die chamber 13 defines a void 47 and includes at least one inlet port 48, through which feed material is introduced from the holding chambers 42 via the outlet conduit 44. Extrusion pressure generated in the plasticizing step (frictional extrusion) generates sufficient force to move the material through the apparatus. Inlet ports at locations of large cross-section in the die chamber permit low initial extrusion pressures. By locating inlet ports at area of large cross-sectional area, the initial pressure required to move the extrusion front further into the die chamber is reduced. Inlet ports may have any cross-sectional geometry including, but not limited to, elliptical, circular and rectangular geometries. The cross-sectional geometry may even substantially match the local contour of the die chamber. Inlet port geometry is typically selected to minimize extrusion pressure. Further, since forming extrusion increases as the die chamber cross-section narrows, it is desirable to maintain extrusion pressure as low as possible for as long as possible to minimize stress in the die chamber. These two oftentimes competing factors should be considered when configuring the apparatus of the present invention.

The die chamber 13 is coupled to the outlet conduit 44 of the holding chamber 42 using conventional coupling means, including, but not limited to bolts, fasteners, and the like, to maintain application of transverse pressure (indicated by arrows 50). Transverse pressure is applied against opposing blocks 51 and 52. Block 51 is securely fastened to the extrusion apparatus, while block 52 is removable for gaining access to the die chamber. Feed material flow into the die chamber may be monitored and controlled using monitoring means and sealing means (see U.S. Pat. No. 5,383,347 for further detail, hereby incorporated by reference).

A pressure means 14 is used to apply pressure to a material within the die chamber 13. Typical pressure means includes, but is not limited to, a movable member such as a solid ram, plunger or screw which can be moved into and out of pressure contact with the die chamber. The pressure may be mechanical pressure or otherwise. By "mechanical pressure" as that term is used herein it is meant that pressure is obtained by application of an object against the feed material. Actuation of that object, typically a ram or plunger, may be other than mechanical, for instance by use of hydraulic pressure. It is also within the scope of the pressure means to use other pressurizing techniques, such as hydrostatic pressure applied directly to the die chamber. Conventional means for apply a hydrostatic pressure to a die chamber are contemplated as within the scope of the invention.

In the embodiment illustrated in FIG. 1, the means for directing feed material into the die chamber operates independently of the pressure means. By independent operation, it is meant that the pressure means does not hold and deliver feed material into the die chamber. The pressure means may, however, assist in the delivery of feed material by application of a supplemental pressure onto the feed material. The pressure means may be positioned and located so that pressure is applied to the die chamber from the same location used for introduction of the feed material. In an alternative embodiment, the pressure means may be positioned and located so that pressure is applied at a different location than the location used for introduction of the feed material. Further, the plasticizing means and the pressurizing means may be located at an angle in the range of 30° to 120°, and preferably 45° to 90°, from one another. In another embodiment, they may be positioned at substantially a zero degree angle from one another.

Figure 4:
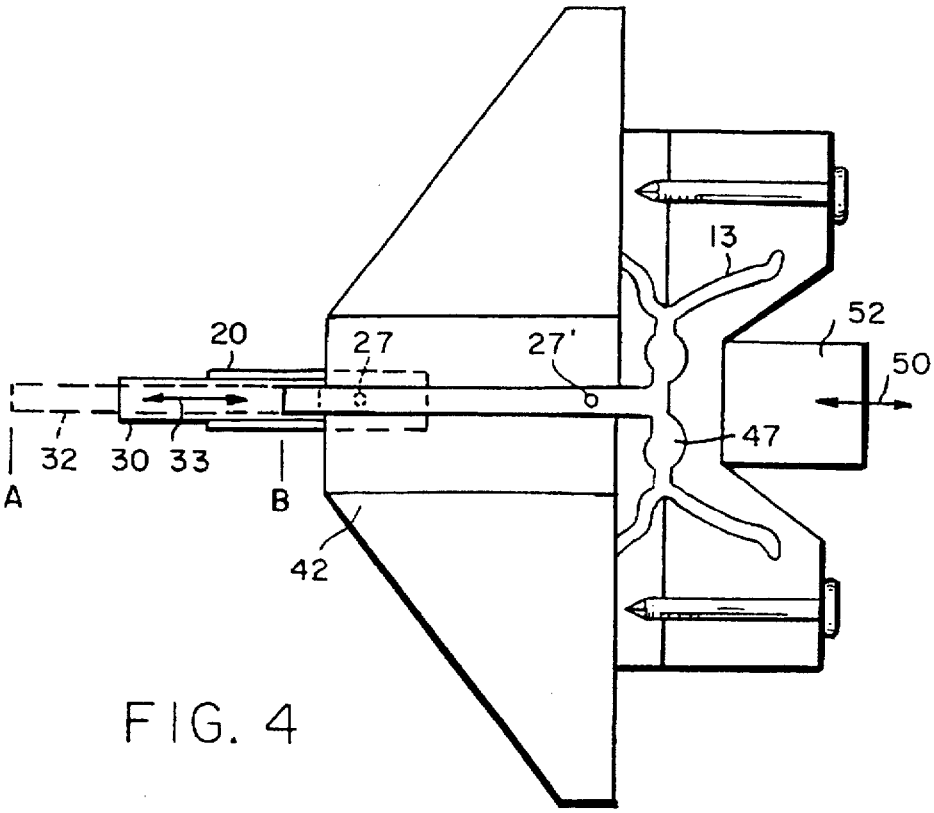
FIG. 4 is a cross-sectional view of an embodiment of the invention illustrating the location of the pressure means in first and second slidable positions.

FIG. 4 is a cross-sectional illustration of the operation of one embodiment of the invention, in which the pressurizing means is a frictional extrusion apparatus and in which the pressure means is a solid piston, slidably housed within a close-fitting sleeve. The frictional extrusion apparatus and ram-sleeve setup are at substantially zero degrees from one another. A frictional extrusion apparatus 20, in which the feed material is extruded radially from the wheel and into passageway 27, is located on the underside of holding chamber 42. Sleeve 30 is positioned adjacent to the holding chamber. A ram 32 is slidably positioned within the sleeve 30. An opening in the holding chamber permits the ram to move into and out of the holding chamber. The ram moves as indicated by arrow 33 from a first position "A", in which the ram is outside the holding chamber, to a second position "B", in which the ram passes through the holding chamber and abuts the die chamber. The "stroke" of the ram (movement of the ram from the first to the second position) may be longer or shorter than that indicated in FIG. 4. It may be desirable for a shorter stroke to position the passageway closer to the die chamber, for example, as indicated by 27'.

In operation, the feed material is plastically extruded from the frictional extrusion source into the holding chamber via passageway 27. The holding chamber fills with feed material, which is introduced under extrusion pressure into the die chamber. The ram then is actuated and moves from a first position external to the holding chamber to a second position abutting the die chamber. As it contacts feed material, it forces it into the die chamber and exerts pressure to plastically work the material and reduce porosity and air entrapment. Depending on the relative position of ram 32 and passageway 27 the ram may also act as a valve, sealing the holding chamber off from the frictional extrusion source, thereby enabling a quasi-continuous extrusion process to occur. After, the molding operation is complete, the ram is withdrawn, the die chamber is removed and the formed article is ejected from the die.

Figure 5:
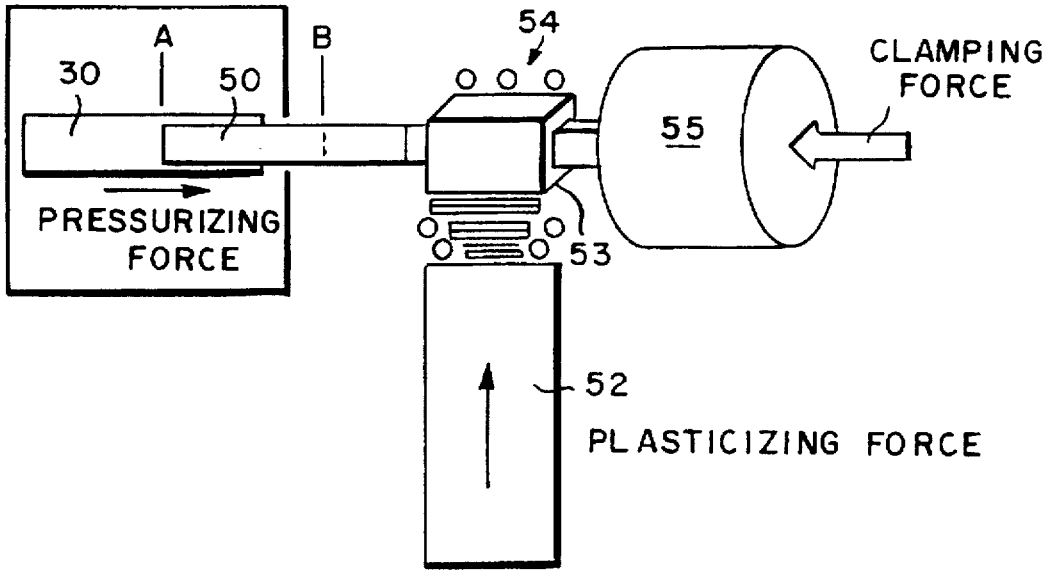
FIG. 5 is a view of another embodiment of the invention showing position of the pressurizing means and plasticizing means at approximately right angles.

FIG. 5 is a cross-sectional illustration of another embodiment of the invention, in which the pressure means is at fight angles to the plasticizing means. The pressurizing means is represented as a plunger or ram 50 and the plasticizing means is represented as arrow 52. Holding chamber 53 is housed within heater 54, which helps to maintains the plasticity of the feed material. The feed material is rendered plastic by application of the plasticizing means and maintaining the material at an elevated temperature. A temperature of up to 0.8 $T_m$, where $T_m$ is the melting point of the material, is suitable. The plastic feed material is directed into holding chamber 53 and further into the die chamber ,which is represented by cylindrical chamber 55, under extrusion pressure. Plunger 50 is actuated and moves from a first position "A" outside the holding chamber to a second position "B" abutting the die chamber. As it contacts feed material, it forces it into the die chamber and exerts pressure to plastically work the material and reduce mold porosity. Depending on the relative position of ram 32 and passageway 27 the ram can also act as a valve, sealing the holding chamber off from the frictional extrusion source, thereby enabling a quasi-continuous extrusion process to occur. After, the molding operation is complete, the ram is withdrawn, the die chamber is removed and the formed article is ejected from the die.

For reasons of thermal stability, it may be desirable that the apparatus operate quasi-continuously, in that for the case where plasticizing means is frictional extrusion, one cannot turn the machine "off". Disruption of the mold filling process causes thermally unstable transients to form and uneven heating, resulting in metal loss or nonuniform product quality in the final product. Thus, as is shown in FIG. 1, there may be additional molds 15 and 16 for continuously receiving plasticized feed material. A quasi-continuous operation of the frictional extrusion apparatus may be accomplished in various ways. For example, the speed of the rotatable wheel used in frictional extrusion may be reduced to reduce throughput of feed material. Reduction of the wheel speed from normal operating speeds of about 5.0 to 10.0 rpm, and preferably about 7–8 rpm, down to about 0.05 to 2.0 rpm, and preferably down to about 0.2 rpm, has been found suitable for quasi-continuous operation of the apparatus. Less preferably, unused feed stock can be collected and recycled. It is also possible to redirect feed material out of an addition "relief port" in the holding chamber. The relief port may include a die that reforms the feed material into a solid rod that may be coiled for reuse as a primary feed material to the extrusion or plasticizing means.

Figure 6:
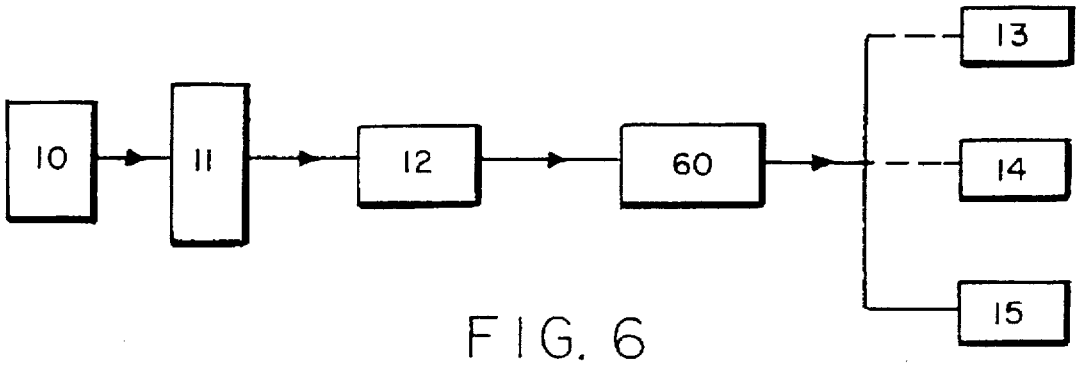
FIG. 6 is a schematic illustration of an embodiment of the invention.

FIG. 6 is a schematic diagram of another embodiment of the invention, in which the pressure means participates in the directing of the feed material into the die chamber. Thus, feed material 10 is provided and introduced into a plasticizing means 11. As above, a frictional extrusion apparatus may be used as the plasticizing means 11 (see, FIG. 2). The plasticized feed material is then directed into a holding or expansion chamber 12, which has been previously described (see, FIG. 3). The feed material, still under pressure from the plasticizing means, is directed into a sleeve 60 which serves as the pressure means. Typically, the sleeve houses a slidable member capable of movement from a first position spaced apart from the die chamber to a second position in pressure contact with the die chamber. The slidable member has substantially the same cross-sectional area as the sleeve, so that in moving from the first to the second position, any feed material within the sleeve is forced into the die chamber. Thus, the pressure means both assists in the introduction of the feed material into the die and applies a supplemental force against the material once within the die chamber.

Figure 7:
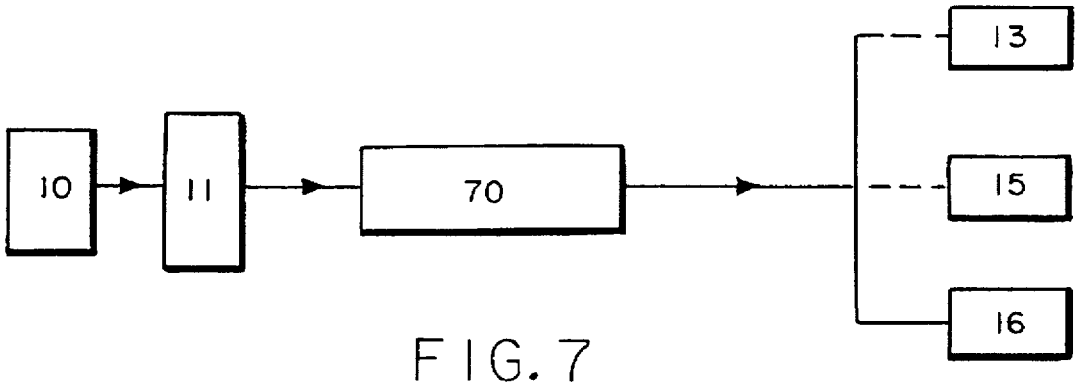
FIG. 7 is a schematic illustration of an embodiment of the invention.

In yet another embodiment of the invention, shown schematically in FIG. 7, feed material from the plasticizing means is introduced directly into a holding chamber 70 which also serves as the pressure means. Typically, in this embodiment, the holding chamber is in the form of a sleeve which houses a slidable member capable of movement from a first position spaced apart from the die chamber to a second position in pressure contact with the die chamber. The slidable member has substantially the same cross-sectional area as the holding chamber/sleeve 70 so that in moving from the first to the second position, any feed material within the sleeve is forced into the die chamber. The holding chamber/sleeve 70 is in flow communication with both the plasticizing means and the die chamber. The holding chamber/sleeve 70 is capable of receiving feed material from the plasticizing means, and thus is the functional equivalent to both the holding chamber and the pressure means.

Both the embodiment shown in FIGS. 6 and 7 have the additional feature of being able to administer a metered amount of feed material to the die chamber. By metered amount, it is meant a predetermined amount of feed material, typically a volume amount. The metered amount is desirably the exact amount of feed material needed to fill the die chamber, thereby reducing waste and simplying processing. In order to deliver a metered amount of feed material to the die chamber, the slidable member is positioned within the sleeve, so that the available volume within the sleeve corresponds substantially to the amount of material it is desired to deliver to the die chamber. A passageway from either the holding chamber or the plasticizing means is located flowise down stream from the slidable member position. When the sleeve is full, the slidable member is actuated and moves from its position behind the inlet passageway to a position in abutment (or pressure contact) with the die chamber. In doing so, the contents of the sleeve are introduced into the die chamber under the force of the pressure means.

Figure 8:
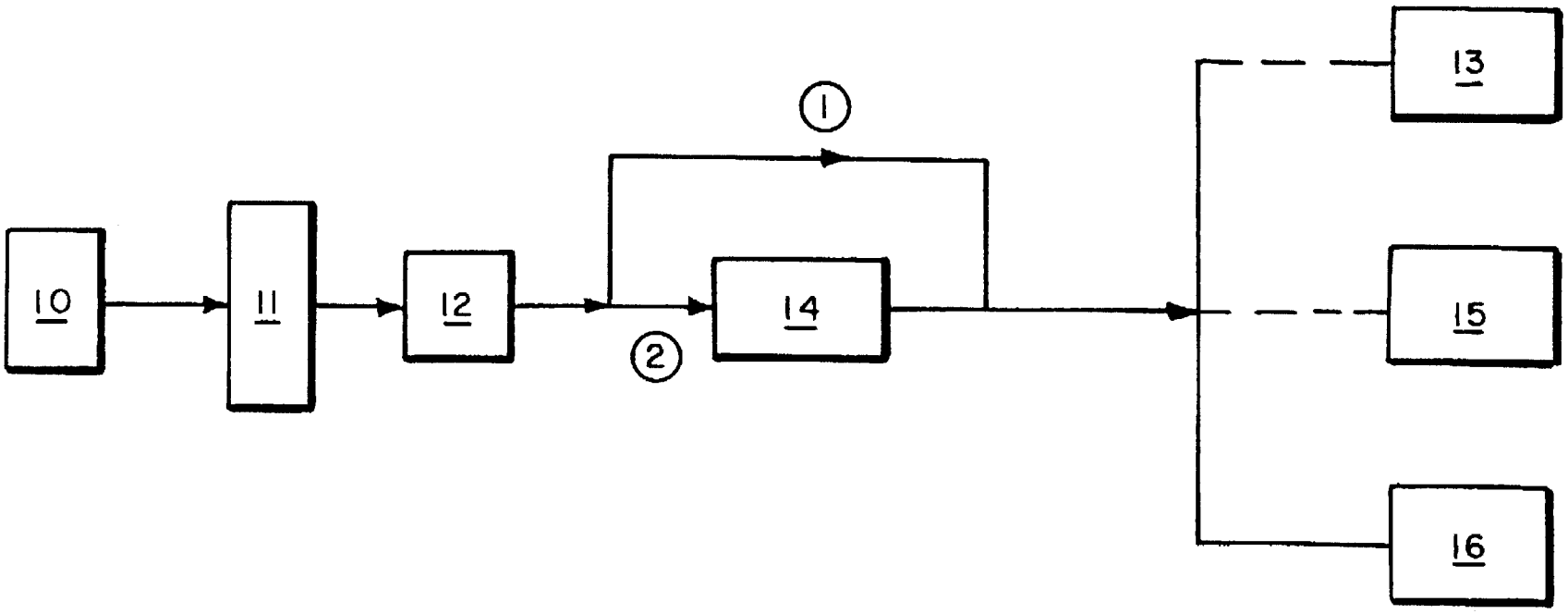
FIG. 8 is a schematic illustration of yet another embodiment of the invention.

In yet another embodiment of the invention, shown schematically in FIG. 8, introduction of the feed material is facilitated by both the directing means and the pressure means. Thus, feed material 10 is provided and introduced into a plasticizing means 11. As above, a frictional extrusion apparatus may be used as the plasticizing means 11 (see, FIG. 2). The portion of the plasticized feed material needed to fill the die chamber is then directed into a holding or expansion chamber 12, which has been previously described (see, FIG. 3). The plasticized feed material is then directed into a die chamber 13. Typically, about 50% to 95% of the material needed to fill the die chamber is introduced from the holding chamber. In a second step, feed material 10 is directed into a pressure chamber, such as pressure chamber 60 described immediately above. The plasticized feed material is then directed into the die chamber and pressure is applied to the material within the mold. Typically, about 5% to 50% of the material needed to fill the die chamber is introduced from the pressure chamber. The ability to add feed material from two sources permits the addition of material to adjust for any shrinkage or thermal contraction of the feed material which may occur during processing.

Other embodiments of the invention will be apparent to the skilled in the art from a consideration of this specification or practice of the invention disclosed herein. It is intended that the specification and examples be considered as exemplary only, with the true scope and spirit of the invention being indicated by the following claims.

What is claimed is:

1. An apparatus for the forming of a shaped article, comprising means for plasticizing a feed material;

a die chamber;

means for delivering a plasticized feed material from the plasticizing means and into the die chamber, the delivery means in flow communication with the plasticizing means and the die chamber; and means for applying a pressure to a material in the die chamber, the means for applying pressure comprising a member capable of movement from a first position spaced apart from the die chamber to a second position in abutment with a material in the die chamber.

2. The apparatus of claim 1, wherein the delivery means comprises:

a chamber for holding a plasticized material received from the plasticizing means and into the die chamber, the holding chamber in flow communication with the plasticizing means and the die chamber.

3. The apparatus of claim 1, wherein the member is a solid piston or plunger.

4. The apparatus of claim 2, wherein the means for applying comprises a member capable of movement from a first position spaced apart from the die chamber to a second position in abutment with the die chamber, the member positioned and located adjacent to the holding chamber, such that movement from the first position to the second position of the member causes the member to pass through the holding chamber.

5. The apparatus of claim 1 or 2, wherein the means for applying pressure comprises:

a piston housing adjacent to the die chamber; and a slidable member housed within the piston housing, the member capable of movement from a first position spaced apart from the die chamber to a second position in abutment with a material in the die chamber.

6. The apparatus of claim 1 or 2, wherein the means for applying pressure is located remote from the means for delivering a plasticized material into the die chamber.

7. The apparatus of claim 1 or 2, wherein the means for applying pressure and the means for delivering a plasticized material into a die chamber are positioned and located so as to permit delivery of the plasticized material into a die chamber and application of pressure at a same location.

8. The apparatus of claim 1, wherein the means for applying pressure comprises:

a sleeve in flow communication with the die chamber and having an inlet in flow communication with the plasticizing means for receiving a feed material from the plasticizing means; and a slidable member housed within the sleeve the member capable of movement from a first position spaced apart from the die chamber to a second position in abutment with a material in the die chamber, whereby a material is capable of entering the die chamber under pressure.

9. The apparatus of claim 8, wherein the sleeve comprises an inlet for receiving plasticized feed material, the inlet flowise downstream from the first position of the slidable member.

10. The apparatus of claim 1, wherein the delivery means and the means for applying a pressure comprise;

a chamber for holding a plasticized material received from the plasticizing means, the holding chamber in flow communication with the plasticizing means;

a sleeve having an inlet in flow communication with the holding chamber for receiving feed material from the holding chamber and a outlet adjacent to and in flow communication with the die chamber; and a slidable member housed within the sleeve, the member capable of movement from a first position spaced apart from the die chamber and flowwise upstream from the inlet to a second position abutting the die chamber.

11. The apparatus of claim 2, wherein the means for applying pressure comprises:

a sleeve in flow communication with the die chamber and having an inlet in flow communication with the plasticizing means for receiving a feed material from the plasticizing means; and a slidable member housed within the sleeve the member capable of movement from a first position spaced apart from the die chamber to a second position in abutment with a material in the die chamber, whereby a material is capable of entering the die chamber under pressure.

12. The apparatus of claim 2, further comprising heating means for the heating of the holding chamber.

13. The apparatus of claim 10 or 11, wherein the sleeve is adapted for delivery of a metered amount of material into the die chamber.

14. The apparatus of claim 8, 10, or 11, further comprising heating means for the heating of the sleeve.

15. The apparatus of claim 2, 1, 8, 10, or 11, wherein the means for plasticizing a feed material is selected from the group consisting of a frictional extrusion source, a hydrostatic extrusion source hot forging and cold forging.

16. The apparatus of claim 15, wherein the frictional extrusion source comprises a first moving surface and a second non-moving surface in facing relationship, the first and second surfaces defining between them a passageway, the passageway including an entry point for introduction of a feed material and an exit point for release of frictionally extruded material.

17. The apparatus of claim 1, further comprising a heater for heating the delivery means.

18. A method for production of shaped articles, comprising:

introducing a feed material into a frictions/extrusion source;

receiving extruded feed material from the extrusion source in a metering chamber, the metering chamber in flow communication with the frictional extrusion source;

applying an additional pressure to the extruded materials within the metering chamber;

directing extruded feed material from the metering chamber under pressure into a die chamber contactable in flow communication with an outlet conduit of the metering chamber monitoring extrusion of extruded feed material from the metering chamber; and selectively controlling sealing means disposed in the outlet conduit, the sealing means responsive to monitoring flow of extruded material therethrough.

19. The method of claim 18, wherein monitoring is accomplished using a sensing technique selected from the group consisting of ultrasonic, pressure, electromagnetic, laser ultrasonic and inductive techniques.

20. The method of claim 18, wherein monitoring occurs at points flowise downstream of the outlet conduits at a preselected distance therefrom.

* * * * *